United States Patent [19]

Bubley

[11] Patent Number: 4,724,761

[45] Date of Patent: Feb. 16, 1988

[54] SOLVENT GUARD SYSTEM

[75] Inventor: Henry J. Bubley, Deerfield, Ill.

[73] Assignee: American Screen Printing Equipment Company, Chicago, Ill.

[21] Appl. No.: 864,058

[22] Filed: May 16, 1986

[51] Int. Cl.[4] ..... B05C 17/06

[52] U.S. Cl. ..... 101/127.1; 118/733

[58] Field of Search ..... 101/114–115, 101/123, 126, 128, 127, 129, 127.1; 118/733, 264, 301, 406

[56] References Cited

U.S. PATENT DOCUMENTS

| | | | |
|---|---|---|---|
| 3,731,623 | 5/1973 | Bubley et al. | 101/114 |
| 3,859,917 | 1/1975 | Bubley et al. | 101/123 |
| 3,955,501 | 5/1976 | Bubley et al. | 101/123 |
| 3,988,986 | 11/1976 | Zimmer | 101/123 |
| 4,276,826 | 7/1981 | Bubley et al. | 101/123 |
| 4,307,662 | 12/1981 | Mitter | 101/127.1 |
| 4,537,126 | 8/1985 | Bubley | 101/123 |
| 4,545,300 | 10/1985 | Jensen | 101/123 |
| 4,637,308 | 1/1987 | Vidoni | 101/114 |

FOREIGN PATENT DOCUMENTS

| | | | |
|---|---|---|---|
| 2365 | 1/1985 | Japan | 101/114 |
| 1009740 | 11/1965 | United Kingdom | 101/114 |

*Primary Examiner*—E. H. Eickholt

*Attorney, Agent, or Firm*—Fitch, Even, Tabin & Flannery

[57] ABSTRACT

A master frame assembly for use in a screen printing press carries an upper seal means to seal directly to a screen printing frame to provide an enclosed sealed chamber within the screen frame to contain solvents associated with the ink within the sealed chamber. The preferred upper seal means includes a traveling cover sheet which is pressed directly into sealing engagement with the underlying screen frame about all four sides of the screen frame. Mounted on the master frame are side seal bars for pressing the traveling marginal edges of the sheet against the underlying sides of the screen frame. These side seal bars are adjustably and movably mounted on the master frame so that they may press the traveling cover sheet against the sides of each of several different widths of screen frames.

9 Claims, 8 Drawing Figures

SOLVENT GUARD SYSTEM

BACKGROUND OF THE INVENTION

This invention relates to a master frame assembly for use with a screen printing apparatus and, more particularly, to a master frame assembly having a sealed chamber for containing an ink solvent for the ink being applied through a printing screen to an underlying substrate.

The present invention relates to a screen printing apparatus which uses a master frame or chase to which are releasably clamped screen printing frames having a screen on which is deposited ink which is forced through screen by a squeegee and flood bar assembly. The present invention is also directed to providing such screen printing apparatus with a new and improved sealed chambers or solvent guard system over that which is disclosed in U.S. Pat. No. 4,545,300 and in pending patent application Ser. No. 723,930 filed Apr. 16, 1985, entitled "Screen Printing Assembly".

The sealed chamber or solvent guard system contains the ink solvent against escape to the ambient atmosphere. Loss of solvent vapor from the ink dries the ink and contaminates the ambient atmosphere particularly in a confined and enclosed room. Better printing may be achieved by containing the solvent within a sealed chamber. However, the sealed chamber should not interfer with the usual reciprocating movement of the squeegee assembly relative to the printing screen or the usual adjustments of the squeegee and flood bars from a convenient location external to the master chase and screen frame carried thereby.

U.S. Pat. No. 4,545,300 discloses a support frame which is used in lieu of the usual master frame or chase with the support frame having a movable, upper flexible cover sheet attached to and movable with a squeegee and flood bar mechanism. This movable upper cover sheet is sealed to the support frame to define therewith the upper part of the sealed chamber. The adjustment controls for the squeegee and flood bar are positioned above the flexible sheet which is attached centrally thereof to the squeegee mechanism and which has its opposite ends attached to winding spools or reels for the cover sheet. The support frame disclosed in U.S. Pat. No. 4,545,300 has a considerable depth in order to mount the cover sheet, reels and the seals. Unlike the frame or chase which can releasably support various widths of screen frames used by the screen printer, the support frame is sized for only one size of screen printing frame. Thus, the sealed chamber illustrated in U.S. Pat. No. 4,545,300 is included in a specially constructed support frame which needs to be substituted for the conventional master frame or chase.

The present invention is directed to a master frame or chase assembly which has been adapted to provide a sealed chamber and which can provide a sealed chamber with several different widths or lengths of screen frames so that it can be used in the manner of the conventional master chase while providing the sealed chamber to contain the solvent vapors. The preferred form of the present invention seals the flexible sheet directly to a screen frame thereby eliminating the depth of frame needed in order to obtain the sealed chamber shown in the aforesaid patent. With the preferred embodiment of the invention, sealing pads or members on the master chase are capable of sealing with several different widths of screen frames which may be mounted in the master frame. The unique construction of the invention allows a reduction in the number of parts needed to form the sealed chamber and provides an economical commercially feasible sealed chamber for otherwise conventional screen printing presses. The invention allows the retrofitting of existing screen printing machines, particularly of the type having a master frame, with a sealed solvent holding chamber cooperating with the screen frame.

Accordingly an object of the present invention is to provide a new and improved master frame assembly having a sealed chamber for solvent vapors.

Another object of the invention is to provide a master frame having a traveling cover sheet to seal directly with the sides of an underlying screen frame to form a sealed chamber entirely within the screen frame. These and other objects and advantages of the invention will become apparent from the following detailed description taken in connection with the accompanying drawings in which.

Figure 1:
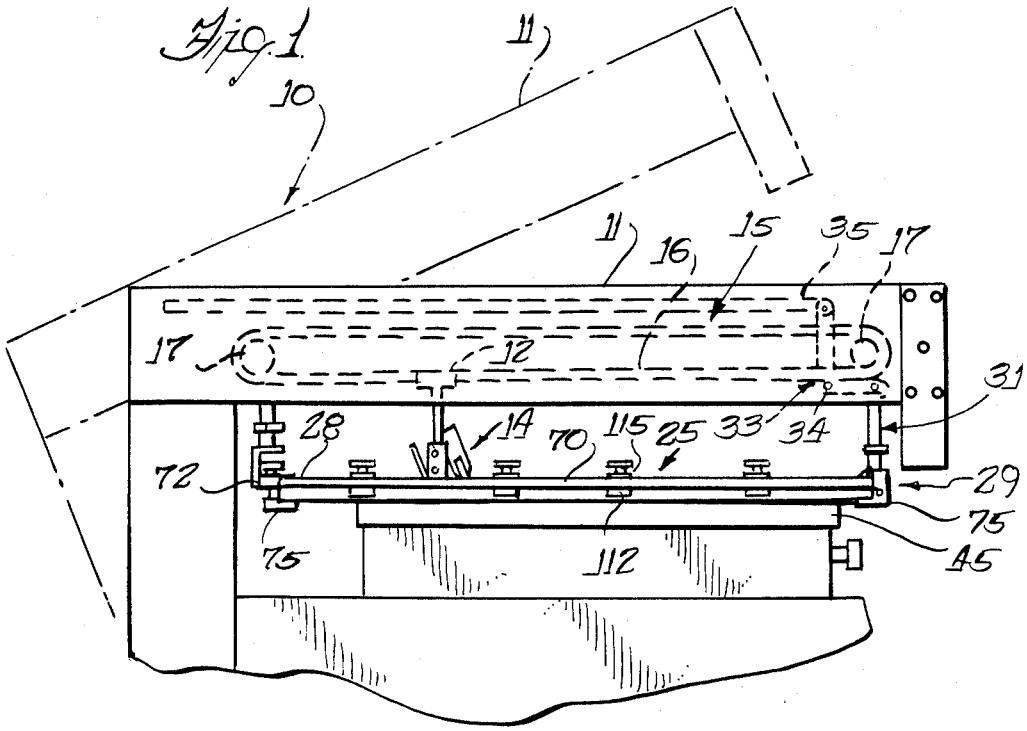
FIG. 1 is a side elevational view of a clam shell screen printing apparatus embodying the master frame assembly of the present invention.
Figure 2:
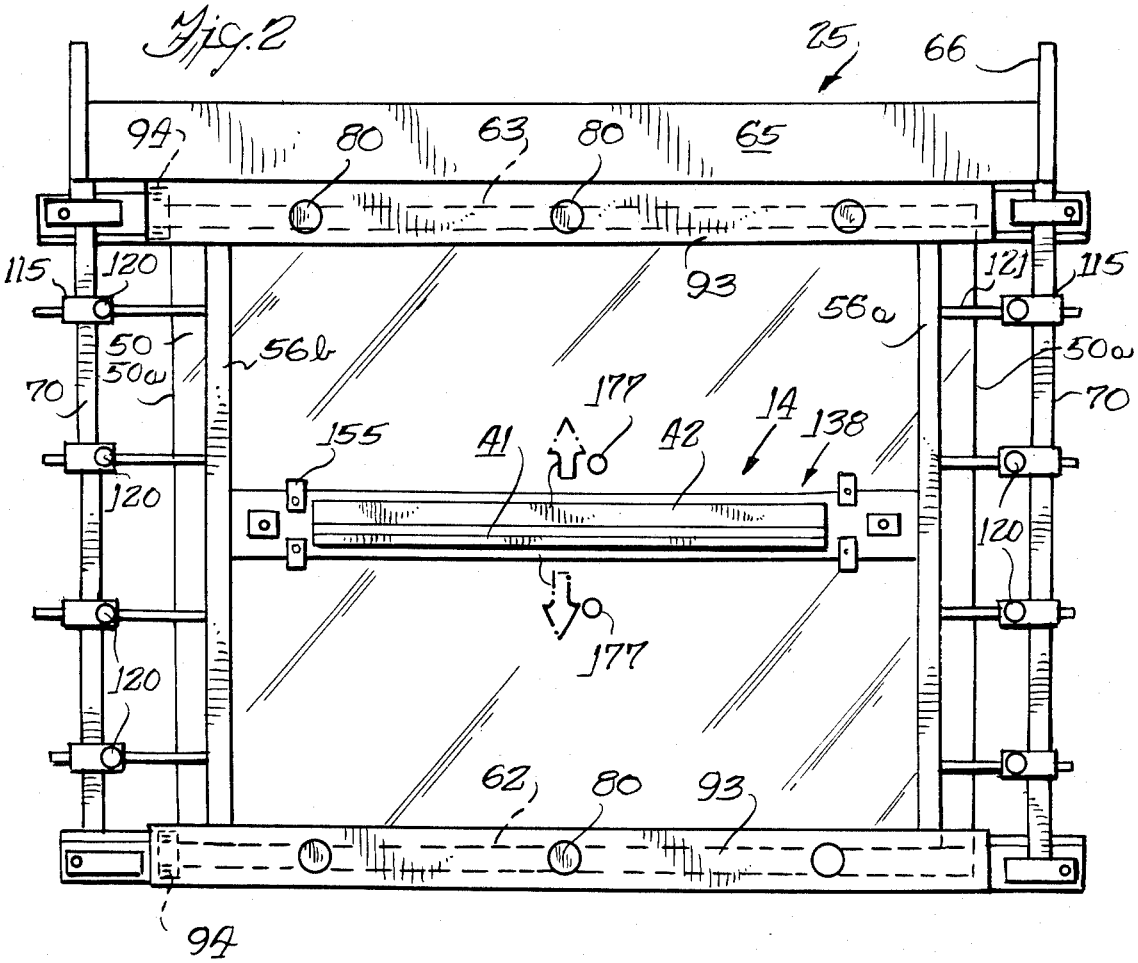
FIG. 2 is a plan view of the master frame assembly.

As shown in the drawings for purposes of illustration, the invention is embodied in a screen printing apparatus 10 which screen printing apparatus may be of various other kinds, such as a cylinder type of printing apparatus, a post type of printing apparatus in which the master frame assembly moves vertically while being supported by upstanding vertical posts, or a screen printing apparatus in which the master chase assembly reciprocates past a stationary squeegee assembly. The illustrated printing apparatus 10 is of the so-called clam shell type having a pivoted head 11 which swings about a rear axis with the head lifting between a lowered printing position which is shown in solid lines in FIG. 1 and an upper sheet feed or removal position which is shown in phantom lines in FIG. 1. Mounted within the pivotal head 11 is a squeegee carriage 12 which supports a squeegee and flood bar assembly 14. A drive 15 such as an endless chain 16 is mounted in the printing head to turn about sprockets 17 which are mounted in the printing head and the drive 15 reciprocates the squeegee and flood bar assembly 14 in a well known manner. Rather than a chain drive another common actuating drive is by a linkage mechanism such as shown in U.S. Pat. Nos. 3,731,623; 3,859,917; and 3,955,501. A mechanical drive for moving the carriage by means of a chain drive is disclosed in U.S. Pat. No. 4,525,708 and details of a squeegee and flood bar assembly and actuator are disclosed in U.S. Pat. No. 4,276,826.

As disclosed in these patents, a master frame or chase 25 is connected to the printing head, usually in a manner to allow off contact printing in which the rear end 28 of the chase pivots about a rear axis 30 with the front end 29 of the screen being lifted to raise the screen for off contact printing by an off contact mechanism such as shown in U.S. Pat. No. 4,537,126. The illustrated off contact mechanism includes adjustable supporting links 31 connected to the front end of the chase. The links 31 are connected to bell crank levers 33 pivoted on pivot pins 34 on side frames of the printing head for lifting the front end of the chase when upstanding arms of the bellcranks are pulled rearwardly by horizontal actuator rods 35. A rear adjustable member 37 is pivotally connected to the rear end of frame at the pivot axis, as will be described hereinafter. The master chase supports a screen printing frame 36 which is usually in the form of a tubular framework having a screen 40 mounted in the lower portions of the tubular framework and against which is positioned a squeegee 41 and a flood bar 42 for forcing ink through the screen to print on a substrate 44 which is usually positioned on a vacuum bed or base 45 which holds the workpiece or substrate 44 against movement during the printing operation.

The illustrated screen frame 36 is a conventional screen frame which has four lightweight aluminum tubes or members, there being a pair of side members **36*a* and 36*b* spanning and joined to a front end member 36*c* at one end and joined to a rear end member 36*d* at the rear end of the screen frame. Herein, the screen frame members are rectangular hollow tubes and have lower surfaces aligned in a horizontal plane with a printing screen 40 tightly stretched across and in intimate engagement with the undersurfaces of each the four screen frame members 36*a*, 36*b*, 36*c* and 36*d***.

The conventional printing apparatus in use today lacks a solvent guard or sealed chamber so that the ink deposited on the screen may dry as the solvent evaporates. Some of the solvents used in inks are desired to be removed so that the ambient atmosphere is not contaminated with the solvents. In other rare instances, it may be desired to add additional solvents to the ink to obtain better printing. U.S. Pat. No. 4,545,300 discloses a sealed chamber for the solvent from which the solvent could be evacuated or the solvent could be injected into the sealed chamber through ducts if it is desired to improve the printing by the addition of additional solvents. As above explained however, the support frame disclosed in this patent is not a master chase and the support frame has internal seals engaging the traveling sheet for forming an upper portion of the sealed chamber within the support frame itself and this added depth to the sealed chamber. Also, this patented and illustrated support frame is not useable easily with a number of widths of screen frames as is the conventional chase or master frame used on conventional presses which do not have a sealed chamber.

Figure 3:
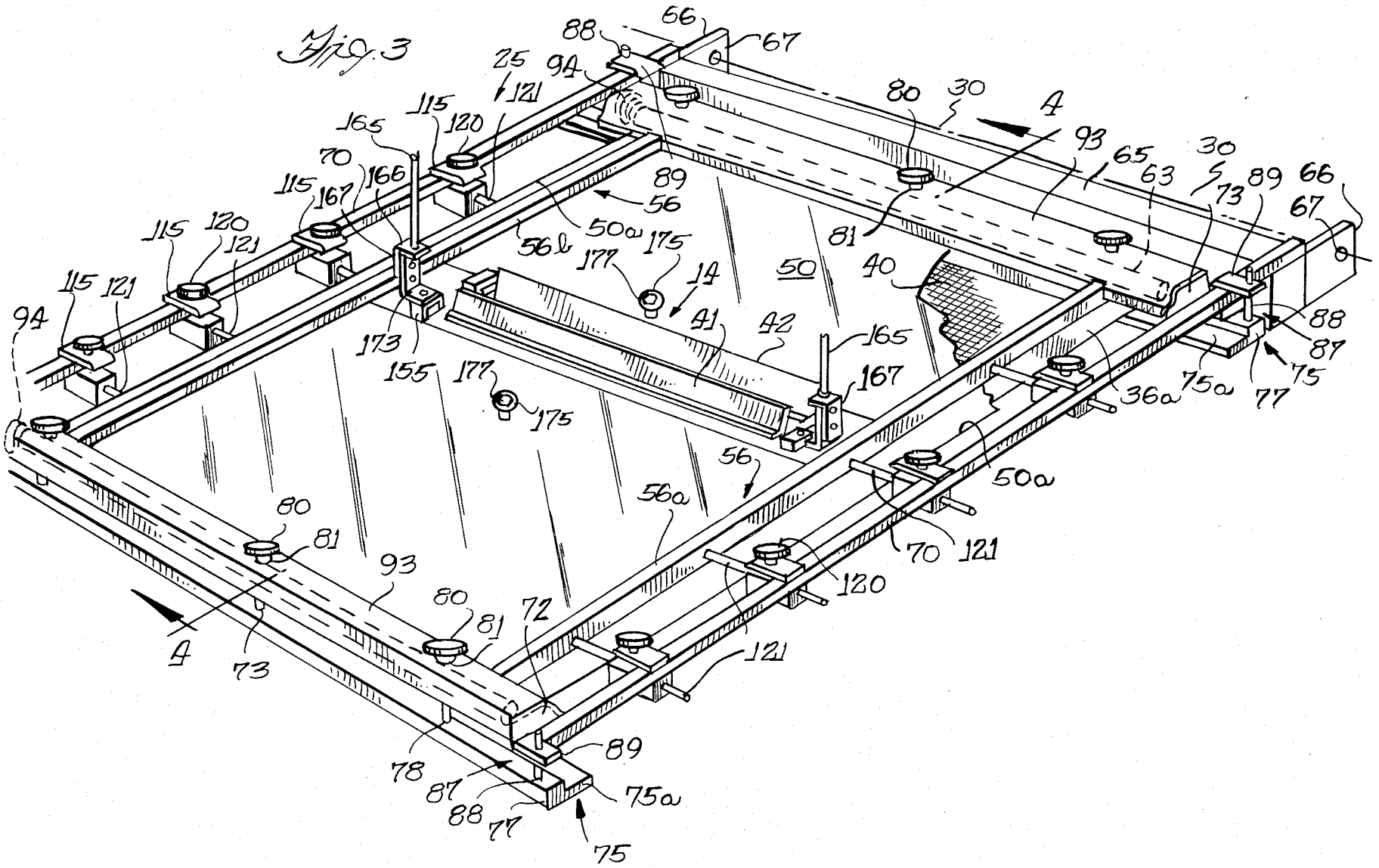
FIG. 3 is a perspective view of the master frame assembly.
Figures 4, 5:
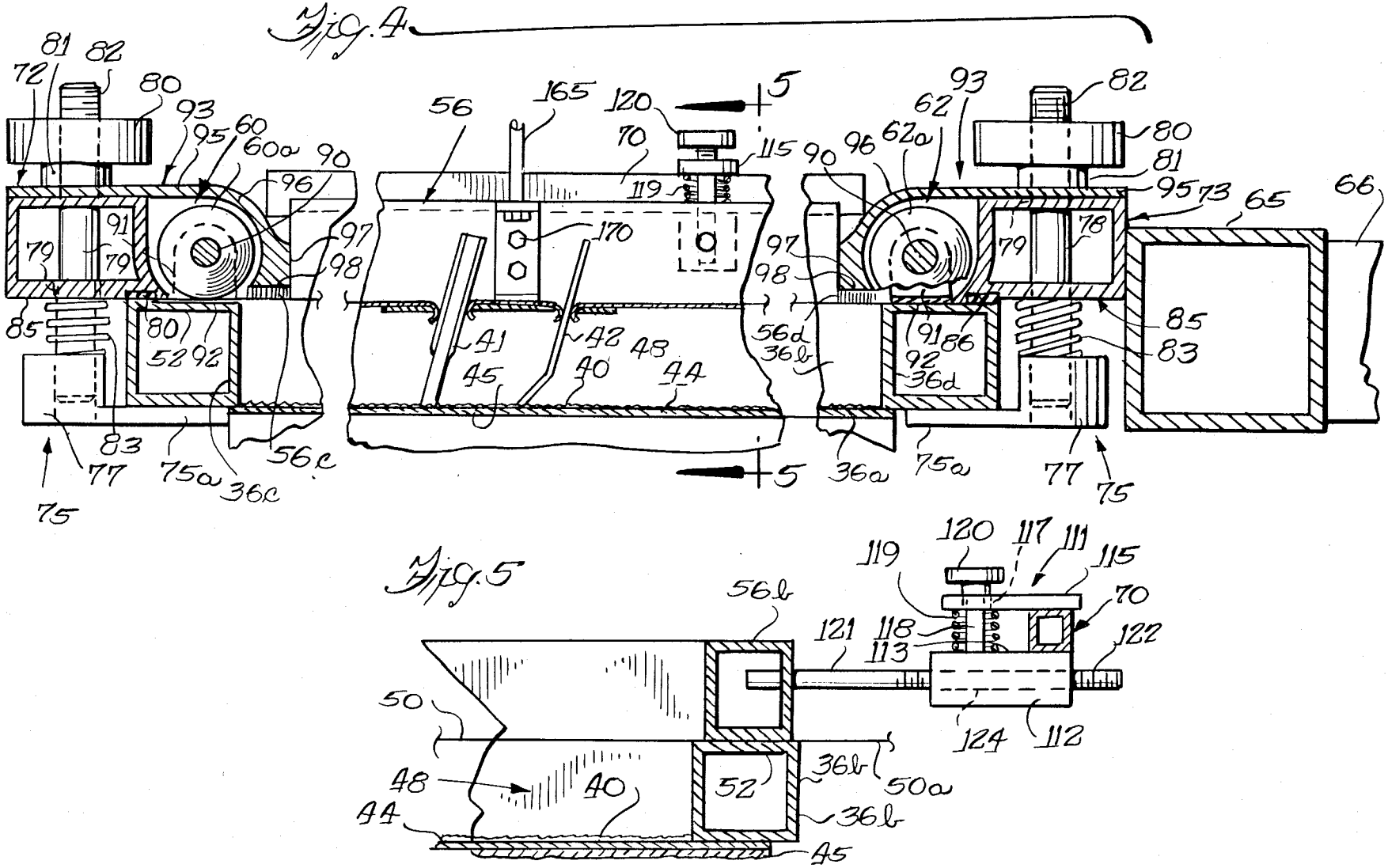
FIG. 4 is a cross sectional view taken substantially along the line of 4—4 of FIG. 3.
FIG. 5 is a cross sectional view taken substantially along the line 5—5 of FIG. 4.

In accordance with the present invention there is provided a new and improved master frame assembly 25 having an upper seal means FIG. 4, to seal directly to the screen frame members **36*a*–36*d*. More specifically, the upper seal means is preferably in the form of a traveling sheet 50 disposed in a generally horizontal plane to abut and seal against the underlying screen frame so that a sealed chamber 48 is formed within the screen frame itself. Preferably, the master frame holds the traveling sheet against the underlying screen frame with a force or pressure to effect a seal between the traveling cover sheet and the screen frame as the squeegee and flood bar assembly 14 are reciprocated trough printing and flood bar strokes. More specifically, the longitudinally extending and traveling edges 50*a* of the cover sheet, as best seen in FIGS. 3 and 5 are pressed into sliding contact with top webs 52 of the side members 36*a* and 36*b* of the screen frame 36 by seal means or pressure pad means 56 which holds and presses down on the respective longitudinally extending edges of the sheet against the side members 36*a* and 36*b* of the screen frame. At the front and rear ends of the cover sheet, the sheet is pressed against the respective front and rear end members 36*c* and 36*d* by the pressure pad means 56 which include pressure pads 56*c* and 56*d* extending over the top webs of the front and rear end members 36*c* and 36*d* of the screen frame and pressing the traveling sheet across its transverse width against these end members of the screen frame as the sheet travels to or from an adjacent spool or reel means 60 and 62 for opposite ends of the cover sheet. Thus, it will be seen that the traveling sheet 50 will be held under pressure with a sealing force contact with all four screen frame members of the screen frame 36. Because the screen frame holds the screen 40 against the substrate 44 and against the base 45, the sealed chamber is then completely enclosed in use so that the solvent will be contained in space 48 between the screen 40 on the bottom and the traveling cover sheet 50 (which is on the top) and the four screen members 36*a*–36*d* (which are on the side of the sealed chamber 48**).

Referring now in greater detail to the illustrated embodiment of the invention, the master frame 25, is as best seen in FIG. 3, formed with a rear horizontally extending tubular frame member 65 which has a pair of rearwardly extending brackets 66 which have holes 67 therein which define the pivot axis 30 and which are connected to the rear chase supports 37 (FIG.1). The master frame further includes a pair of parallel support rods 70 extending forwardly from the tubular frame member 65 to forward ends which are rigidly fastened to a forward master frame tubular clamp or member 72 (FIG. 4) which is parallel to the rear tubular frame member 65. At the rearward end of the master frame, the tubular member 65 has fastened to it a parallel tubular member 73 which is identical in size and shape to the front tubular member 72. The front and rear tubular members are each rigidly fastened to opposite ends of the rods 70 (FIG. 3) and serve as an upper screen clamp, as will be explained in greater detail. The rigidly fastened rods 70 and the front and rear tubular members 72 and 73 combine to form the rectangular master frame which is capable of supporting screen printing frames 36 of various widths as will be described hereinafter.

The screen printing frame 36 is held at its forward and rearward ends by lower screen clamps 75, as best seen in FIG. 4, which are mounted on and depend from the master frame tubular members 72 and 73. More specifically, as best seen in FIGS. 3 and 4, the lower screen clamps 75 have a horizontally extending portion 77 of thick cross section in which are fixedly mounted the lower ends of upstanding posts or studs 78 which project upwardly through apertures 79 in the webs of the upper tubular members 72 and 73, a thumb nut 80 with a collar 81 is threaded. On an upper end 82 of each of the posts 78. A coiled compression spring 83 encircles the lower end of the post 78 and is positioned with its lower coil abutting the thick cross section 77 of the lower screen clamp 75 and the upper coil abutting the lower web of an upper screen clamp 72 or 73. Each of the lower screen clamps 75 has a horizontally extending flange 75*a* which is positioned beneath the lower web of the front and aft screen members 36*c* and 36*d* to support the screen frame as the nuts 80 are tightened to clamp these screen frame members upwardly against the under surface 85 of the upper screen clamps 72 and 73. Preferably, a sealing gasket 86 of elastomeric material is provided on the lower web of the upper screen clamp 72 and 73 to abut the top webs 52 of the respective screen frame members 36*c* and 36*d* to provide an airtight seal between the upper screen clamps and the screen members. By adjusting the thumb nuts 80 on the vertical posts 78, the lower screen clamps 75 may be moved to further compress or to allow expansion of the coiled springs relative to the overhead upper screen clamps. The thumb nuts may be turned to release the screen frame which can be completely removed in a quick and efficient manner and in the usual manner as well known to those skilled in the art.

Additional end clamps 87 (FIG. 3) may be provided to secure the lower screen clamps 75 to the master frame rods 70 at the four corners of the master frame. These end clamps 87 have a threaded post 88 fixed at its lower end to the lower screen clamp 75 and upper threaded clamp bracket 89 threaded for turning on the post to bear against the top side of the master frame rod 70.

The preferred and illustrated upper screen clamps 75 have mounted therein the respective spool means 60 and 61 on which are wound convolutions of the traveling cover sheet 50 forming a coil 60*a* and 62*a*. The illustrated and preferred spool means have a central rotatable shaft 90 which is horizontally disposed and is mounted in rotation in apertured brackets 91 secured to an underlying flange 92 integrally formed with the tubular members 72 and 73, respectively. The brackets are suitably aligned to mount the spool shaft 90 for rotation about the axis of the shaft and suitable coiled rewind springs 94 are attached to each shaft to turn the shafts in the rewind direction to wind the cover sheet in a coil about their respective shafts.

The spool means 60 and 61 are covered by a spool cover 93 which is secured to the upper screen clamps 72 and 73. The spool cover 93 has an upper horizontal flange 95 which has apertures therein through which the posts 78 project and with the collars 81 on the thumb nuts 80 abutting the upper side of the cover flanges 95. The cover flanges extend horizontally over and are tightened flush with the top surfaces of the webs of the respective upper clamp tubular members 72 and 73. At their inner facing ends, the covers have a curved wall 96 extending over the coil of the cover leading to an inner end vertical wall 97 which extends downwardly to a bottom wall 98 on which are affixed the brush-type seals 56*c* and 56*d*. These brush seals extend transversely across the width of the cover sheet and engage the top of the cover sheet and exert a downward force thereon to hold cover sheet in sliding engagement with the top web 52 of screen printing frame members 36*c* and 36*d*. The spool cover 93 may be easily removed with the attached brush seals thereon to provide access to the spool means.

Each end of the cover sheet 50 is attached to the respective shafts 90. The respective shafts 90 are urged by their coiled springs 94 to turn in opposite directions so that each of the shafts 90 is trying wind more of the cover sheet into its coil.

The longitudinally extending marginal edges 50*a* of the cover sheet 50 are urged against the screen frame members 36*a* and 36*b* by their respective pressure pads 56*a* and 56*b* which are preferrably straight elongated hollow extruded bars of aluminum. A series of clamps 111 (FIG. 5) mount the respective pressure bars 56*a* and 56*b* to the master frame side rod 70. As best seen in FIG. 5, the clamps 111 comprise a lower block 112 disposed with an upper side 113 thereon against the underside of the tubular master frame rod 70. An upper parallel clamping plate 115 is disposed parallel to the surface 113 and abuts the top side of the master frame bar and has an aperture 117 therein through which projects the upper end of a threaded stud 118 fixed at its lower end to the block 112. Disposed beneath the plate 115 and compressed thereby against the top surface 113 of the block 112 is a coiled compression spring 119 encircling the threaded stud 118. By turning a threaded thumb nut 120 on the stud 118, the plate 115 and the block 112 clamp the master frame rod tightly therebetween.

To shift the pressure bars 56*a* and 56*b* inwardly or outwardly so as to accommodate different widths of screen frames 36, the respective pressure bars 56*a* and 56*b* are mounted on horizontally extending threaded shafts 121 having threaded ends 122 threaded through a threaded bore 124 in the blocks 112. The inner ends of the threaded shafts 121 are secured to the pressure bars. Thus, the threaded blocks 112 may be turned relative to the threaded shafts 121 to move the seal bars 56*a* and 56*b* toward or from their respective supporting blocks 112 and thereby also toward or from their respective master frame rod 70 so as to position the respective pressure bars 56*a* and 56*b* directly over the side screen frame members 36*a* and 36*b*. Preferably the plastic cover sheet 50 is made as wide as the largest size of screen frame 36 to be mounted in the master frame 25. When the smaller width printing screens are used, there will be a surplus marginal edge 50*a* of cover sheet extending outwardly of and along each of the pressure pads 56*a* and 56*b*, as shown in FIG. 5.

Figure 8:
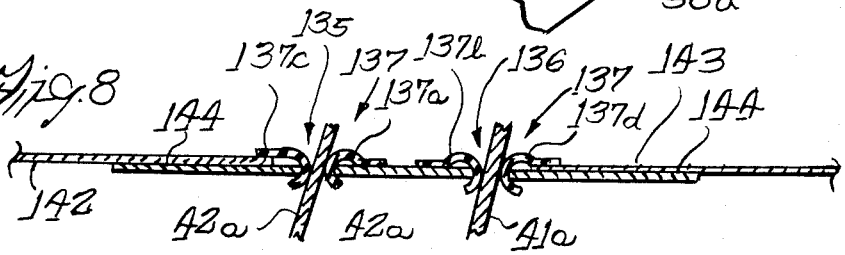
FIG. 8 illustrates the seals between the squeegee and flood bar and the traveling cover sheet.

As explained above, the squeegee and flood bars 41 and 42 have their blade portions 41*a* and 42*a*, as best seen in FIG. 8, mounted for movement vertically through openings 135 and 136 in the top cover sheet 50 so that these blades may shift vertically between flood and print strokes and so that they may be adjusted to provide the desired angle and depth of contact pressure with the screen 40 without having to undo the cover cover 50. Suitable U-shape elastomeric material seal strips 137 have sliding and sealing engagement with the respective squeegee blades and flood bar blades.

Figure 6:
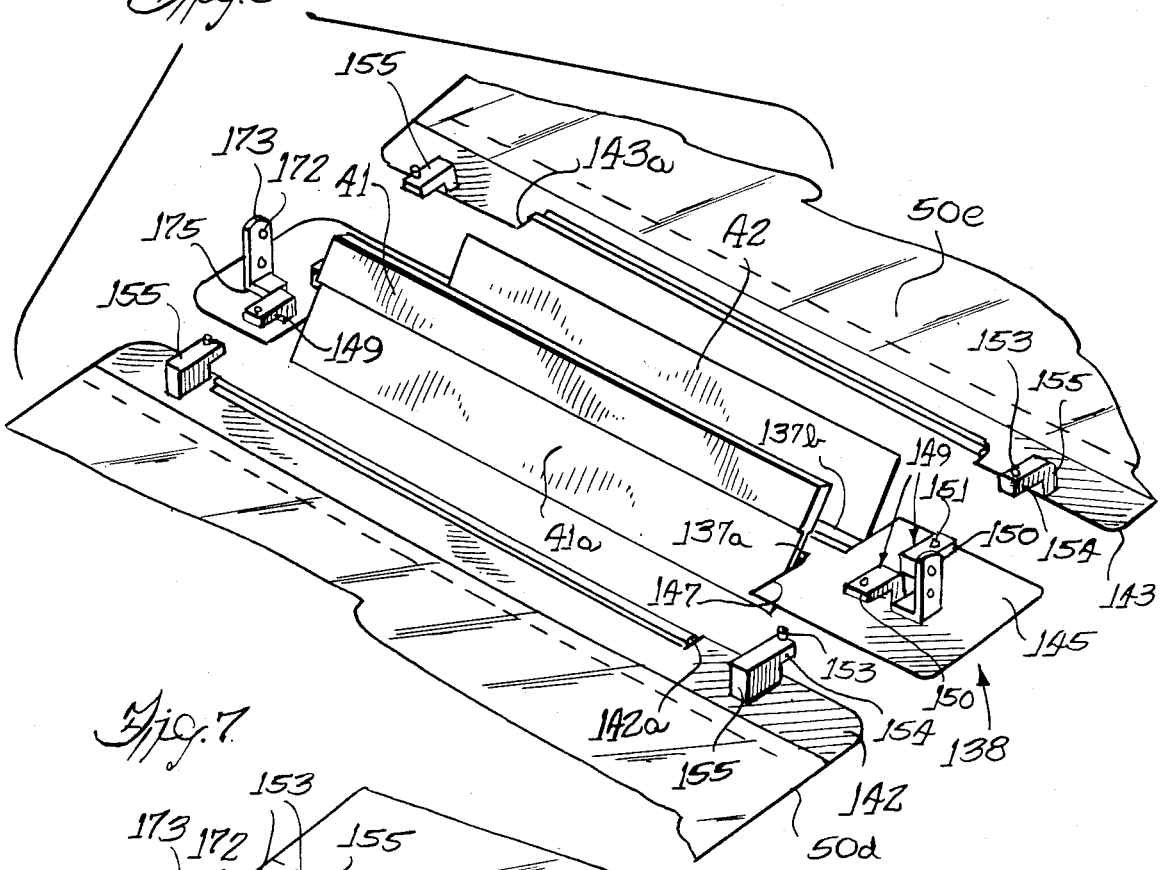
FIG. 6 is an exploded fragmentary view of the connection of the squeegee and flood bar assembly to the flexible sheet.
Figure 7:
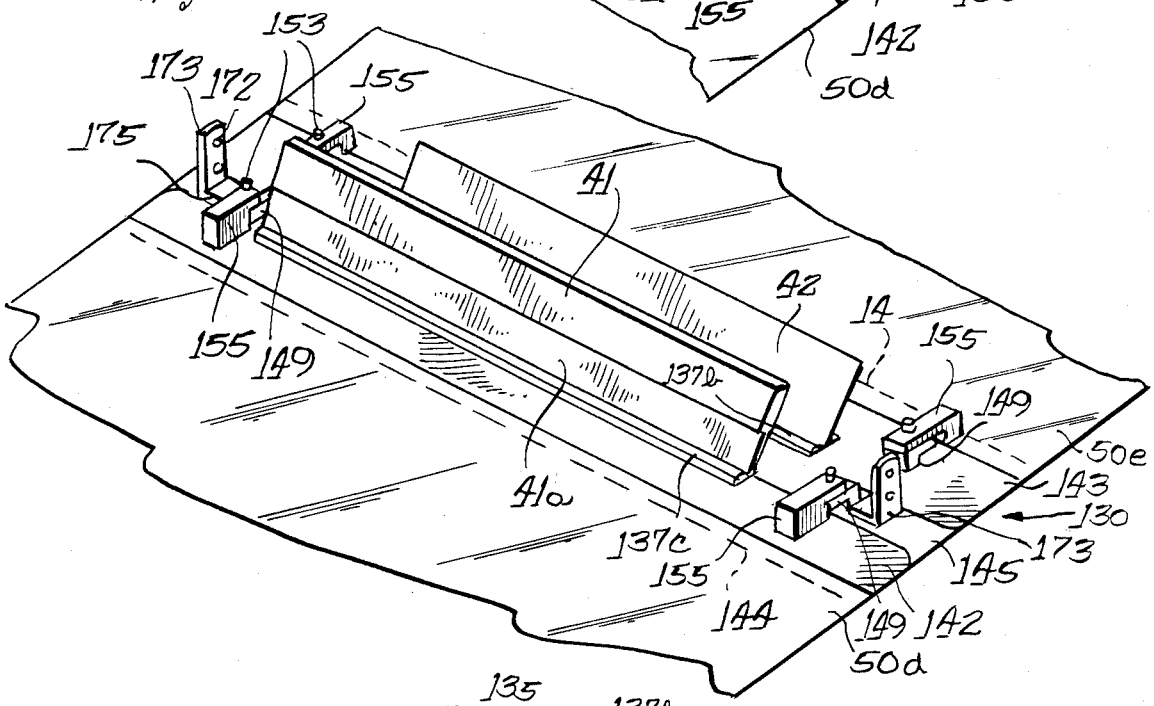
FIG. 7 shows the assembly of the squeegee and flood bar assembly of FIG. 6.

The preferred embodiment of the invention carries the respective seals 137 on a sealing assembly 138, which is shown in FIGS. 6 and 7 as including a metal nose plates 142 and 143 each of which is attached by a suitable adhesive or other attaching means 144 to adjacent edge 50*d* and 50*e* of the flexible plastic cover sheet 50. The cover sheet 50 is really formed of two separate sections each of which has one end attached to its spooling shaft 90 and its other end 50*d* or 50*e* attached to one of the nose pieces 142 or 143. Because the nose pieces plates are each attached to a common center plate 145, the cover sheet sections performed as a single sheet having the assembly 138 in the middle thereof.

The center plate 145 has recessed slots 147 along its opposed longitudinally edges through which project the respective blades 41*a* and 42*a*. The center plate 145 is joined to the nose plates 142 and 143 by a bracket means which includes a pair of angle brackets 149 having oppositely facing legs 150 which have threaded holes 151 to receive a threaded set screw 153 threaded vertically through a threaded bore in a leg 154 of an angle shaped bracket 155 secured to the respective nose plates 142 and 143. By positioning the brackets 155 with their legs 154 over the legs 150 of the brackets 149, as shown in FIG. 7, and then aligning the threaded set screw 153 with the threaded holes 151, the set screws may be screwed into the threaded holes to attach releasably the central nose plate 145 to the respective nose plates 142 and 143.

The central nose plate 145 carries the inner seal strip 137*a* and 137*b* (FIGS. 7 and 8). The nose plates 142 and 143 are formed with central recessed slots 142*a* and 143*a* (FIGS. 6 and 7) extending the length of the respective squeegee and flood bar blades 41*a* and 42*a*. The nose plate 142 carries the seal strip 137*c* and the nose plate 143 carries the sealing strip 137*d*. These seal strips 137*c* and 137*d* are located at the recessed slots 142*a* and 143*a*.

To cause the sheets 50 to travel and reciprocate in a linear manner with the movement and the squeegee and flood bars, the center nose plate 145 is preferably connected to a pair of vertical connecting rods 165, as best seen in FIGS. 3 and 4 which project upwardly to the squeegee and flood bar carriage 12. At ther lower ends the connecting rods 165 have angled shaped brackets 166 with vertical depending legs 167 which are threaded to receive threaded fasteners 170 which are inserted through openings 172 (FIG. 6.) in upstanding L-shaped brackets 173 having a lower leg 175 fixed to the top of the center nose plate 145. Thus, the center plate is detachably connected to the squeegee carriage through the connecting rods 165.

To allow the depositing of ink through the traveling cover, it may be provided with openings 175, as best seen in FIG. 3, covered by caps or plugs 177 which can be removed to allow ink to be inserted into the sealed chamber 148 below the cover sheet 50. The plugs 177 are inserted into the openings 175 to prevent the egress of solvent through the openings during the printing operations. If it is desired to remove solvent from the sealed chamber 48, pipes or ducts (not shown) be provided in flanges 92 of the upper clamps at a location below the cover sheet leaving the spool and above the upper web of the end screen frame members 36*c* and 36*d*. A suitable vacuum pump may connect to the ducts to withdraw air and air-containing solvent from the chamber. Conversely, a solvent could be sprayed through the same ducts into the chamber if a particular need arose for addition of solvents to be injected into the sealed chamber to assist in printing.

The operation of the printing press should be apparent from the foregoing description. The printing press includes a master frame assembly 25 which has a sealing means 56 which seals the traveling cover sheet 50 directly against the sides of the printing screen frame 36. The preferred sealing means 56 includes a pair of side pressure bars 56*a* and 56*b* located over the side edges of the screen frame to press and hold the marginal edges 50*a* of the plastic sheet against the screen frame as the cover sheet travels with the squeegee assembly. The plastic cover sheet is preferably wound at opposite directions into coils on spool means 60 and 61 and the end seals 56*c* and 56*d* at the spool means 60 and 62 hold the transverse extent of the cover sheet against the end screen frame members 36*c* and 36*d* to prevent the escape of solvent bearing air at these transverse ends of the plastic cover sheet. The side pressure bars 56*a* and 56*b* are readily adjustable to accommodate different widths of screen printing frames 36 by turning the threaded rods 121 to shorten or lengthen themselves and thereby to adjust the size of the air gap between the seal bars and the master frame rods 70.

The cover sheet 50 may be made in various sizes and shapes from that illustrated herein and may be made of various materials. The preferred cover sheet is made of flexible plastic and has good ultra-violet light transmitting characteristics.

From the foregoing it will be seen that the present invention provides an improved sealed chamber using the screen frame itself and a traveling cover sheet sealed to the screen frame with the cover sheet being carried by a usual master frame. The cover sheet may be used with various sizes of screen frames which are releasably clamped to the master frame. The master frame functions to releasably hold the different sizes of screen frames and yet has a movable cover sheet therein. The master frame assembly including the cover sheet, its seals and spools may be readily retrofitted to existing screen printing presses.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A master frame assembly for detachably supporting a screen frame and for forming a sealed chamber with an attached screen frame, said master frame assembly comprising;

a master frame having two end members and two side members joined to define a rectangular shaped framework, clamping means on the master frame for releasably clamping a screen frame to the master frame, a traveling cover sheet means covering the upper portion of the screen frame for having sealed engagement with sides of said screen frame to define therewith a sealed chamber above the screen to retain solvents in the sealed chamber, end seal means mounted on the end members for sealing the sheet means to adjacent ends of the screen frame as the sheet means travels across the ends of the screen frame, and side seal means mounted on the side members of said master frame adjacent sides of the screen frame for sealing therewith the traveling side edges of the traveling cover sheet.

2. A master frame assembly in accordance with claim 1 in which spool means are mounted on the end members of the master frame for winding and unwinding of the opposite ends of the traveling sheet.

3. A master frame assembly in accordance with claim 1 in which said side seal means comprises elongated pressure pads mounted on each of said side members of said master frame for engaging the top side of the traveling cover sheet and for pressing the side edges of the cover sheet against the top sides of the screen frame.

4. A master frame assembly in accordance with claim 3 including adjustable mounting means for the pressure pads to adjust the spacing between the opposed pair of the pressure pads to accommodate different widths of screen frames to be secured to the master frame.

5. A master frame assembly in accordance with claim 4 in which said clamping means comprises upper and lower clamps for clamping the upper and lower sides of the screen frame, said spool means being mounted on said upper clamps.

6. A master frame assembly in accordance with claim 3 including spool cover means carried on the upper clamps for covering the spool means rotating to wind or unwind the traveling cover sheet.

7. A sealed chamber for a screen printing apparatus for printing with an ink having a solvent associated therewith on a workpiece supported on a base, said sealed chamber comprising:

a screen frame carrying a screen along a lower side thereof for engaging the workpiece, a squeegee means for moving relative to the screen to print on the workpiece, and an upper seal means covering the upper portion of the screen frame and having sealed engagement with said screen frame to define therewith a sealed chamber above the screen to retain solvents in the chamber, the upper seal means comprising a traveling cover sheet movable along the upper sides of screen frame and attached to said squeegee means to travel therewith.

8. The sealed chamber frame of claim 7 including spool means mounted adjacent to said screen frame for winding and unwinding of the traveling sheet as the squeegee means moves back and forth, and said upper seal means including pressure means for sealing the sheet to the screen frame adjacent said spool means as said cover sheet travels across the sides of the screen frame.

9. The sealed chamber of claim 1 including a master frame for detachably supporting the screen frame, said upper seal means comprising pressure pad means mounted on said master frame and extending to engage the traveling side edges of the traveling cover sheet, and spool means for said traveling cover sheet mounted on said master frame for winding and unwinding the traveling cover sheet thereon.

* * * * *

UNITED STATES PATENT AND TRADEMARK OFFICE

CERTIFICATE OF CORRECTION

PATENT NO. : 4,724,761

DATED : February 16, 1988

INVENTOR(S) : Henry J. Bubley

It is certified that error appears in the above-identified patent and that said Letters Patent is hereby corrected as shown below:

Column 10, Line 12, Change "1" to --7--.

Signed and Sealed this

Eighth Day of November, 1988

*Attest:*

*Attesting Officer*

DONALD J. QUIGG

*Commissioner of Patents and Trademarks*